US010111477B1

(12) United States Patent
Ballas

(10) Patent No.: US 10,111,477 B1
(45) Date of Patent: Oct. 30, 2018

(54) BATTING GLOVE

(71) Applicant: Franklin Sports, Inc., Stoughton, MA (US)

(72) Inventor: John Ballas, Lakeville, MA (US)

(73) Assignee: FRANKLIN SPORTS, Inc., Stoughton, MA (US)

( * ) Notice: Subject to any disclaimer, the term of this patent is extended or adjusted under 35 U.S.C. 154(b) by 320 days.

(21) Appl. No.: 14/875,347

(22) Filed: Oct. 5, 2015

(51) Int. Cl.
*A41D 19/00* (2006.01)
*A41D 19/015* (2006.01)
*A63B 71/14* (2006.01)

(52) U.S. Cl.
CPC ... *A41D 19/01547* (2013.01); *A41D 19/0048* (2013.01); *A63B 71/143* (2013.01)

(58) Field of Classification Search
CPC ..... A41D 19/01547; A41D 19/0048; A63B 71/143
See application file for complete search history.

(56) References Cited

U.S. PATENT DOCUMENTS 3,504,379 A * 4/1970 Glick ..... A63B 71/146 2/16
3,588,917 A * 6/1971 Antonious ..... A63B 71/146 2/161.5
3,952,333 A * 4/1976 Fujita ..... A63B 71/146 2/161.5
3,997,922 A * 12/1976 Huhta ..... A41D 19/00 2/161.1
4,042,975 A 8/1977 Elliott et al.
4,094,014 A 6/1978 Schroeder
4,700,405 A 10/1987 Sternberg
4,766,612 A 8/1988 Patton, Sr.
4,815,147 A 3/1989 Gazzano et al.
4,864,660 A * 9/1989 Sawyer ..... A41D 19/01523 2/161.1
5,083,314 A 1/1992 Andujar
D324,435 S 3/1992 Jeronimo, Jr.
D327,754 S 7/1992 Hochgesang et al.
D328,369 S 7/1992 Hong
5,146,627 A 9/1992 Weiser
5,218,719 A * 6/1993 Johnson ..... A63B 71/146 2/161.1
5,226,190 A 7/1993 Lynch
5,329,639 A 7/1994 Aoki
5,345,609 A 9/1994 Fabry et al.
5,471,682 A 12/1995 Robius et al.
5,517,694 A * 5/1996 Fabry ..... A41D 19/01582 2/161.1
5,528,772 A 6/1996 Cheek
5,640,712 A 6/1997 Hansen et al.
(Continued)

*Primary Examiner* — Richale Quinn
(74) *Attorney, Agent, or Firm* — Joseph B. Bowman

(57) ABSTRACT

A batting glove with a palmar region and finger and thumb stalls of thin and soft tactile leather interconnected with elastic material sections for improved fit and comfort. A split wrist cuff integral with a side split assists in placing the glove on the user's hand. A locking strap of uniform width is attached to the wrist cuff and sections of hook and loop material permit the locking strap to tightly encircle the user's wrist. A triangular patch of non-yielding material is attached to the edge of the palmar region and to the locking strap to tension the palmar region across the user's palm when the locking strap is deployed.

12 Claims, 6 Drawing Sheets

(56) References Cited

U.S. PATENT DOCUMENTS 5,644,795 A * 7/1997 Landis ..... A63B 71/146 2/161.3
5,664,260 A * 9/1997 Weiser ..... A41D 19/02 2/159
5,708,979 A 1/1998 Redwood et al.
5,802,614 A * 9/1998 Melone, Jr. ..... A41D 19/01576 2/161.1
5,815,838 A 10/1998 Lord et al.
5,890,228 A 4/1999 Wagner
5,893,172 A * 4/1999 Haynes ..... A63B 71/146 2/159
5,926,847 A * 7/1999 Eibert ..... A63B 71/146 2/161.2
D417,312 S 11/1999 Hoefs
5,974,588 A 11/1999 Furman
5,983,397 A 11/1999 Seminara
5,987,642 A 11/1999 Webster
5,987,646 A 11/1999 Bolmer
6,052,827 A * 4/2000 Widdemer ..... A63B 71/146 2/16
6,088,834 A 7/2000 Seminara
6,088,835 A 7/2000 Perkins et al.
6,105,162 A 8/2000 Douglas
6,253,382 B1 7/2001 Kleinert
6,279,164 B1 8/2001 Martin
6,389,601 B2 5/2002 Kleinert
6,405,380 B1 * 6/2002 Kuroda ..... A41D 19/01582 2/161.1
6,427,247 B1 * 8/2002 Suk ..... A63B 71/146 2/159
6,550,069 B1 4/2003 Morrow
6,625,815 B2 9/2003 Litke
6,701,530 B2 3/2004 Kleinert
D488,265 S 4/2004 Anderson
6,721,960 B1 * 4/2004 Levesque ..... A41D 19/01523 2/16
6,732,378 B2 5/2004 Novak
6,813,780 B2 11/2004 Morrow
6,889,389 B2 5/2005 Kleinert
6,928,658 B2 8/2005 Taira
6,959,453 B2 11/2005 Best
6,964,063 B2 11/2005 Bamber
6,990,690 B2 1/2006 Gait
7,000,253 B1 * 2/2006 Kleinert ..... A41D 19/01582 2/20
7,000,259 B2 2/2006 Matechen
7,117,540 B2 10/2006 Morrow
7,318,241 B2 1/2008 Morrow
7,370,373 B2 5/2008 Kohler
7,406,719 B2 8/2008 Aoki
7,707,653 B2 5/2010 Kleinert
D629,570 S 12/2010 Kanemitsu et al.
7,882,571 B2 * 2/2011 Robba ..... A63B 71/146 2/161.1
7,895,669 B2 3/2011 Kleinert
7,895,670 B2 * 3/2011 Kleinert ..... A41D 19/01582 2/161.1
8,060,947 B2 * 11/2011 Voravan ..... A41F 1/008 2/161.2
8,132,269 B1 3/2012 Ibon et al.
D661,842 S 6/2012 Ibon et al.
8,256,028 B1 9/2012 Ibon et al.
8,359,667 B2 * 1/2013 Clark ..... A41D 19/0048 2/159
9,089,762 B1 * 7/2015 Magula ..... A63B 71/146
9,302,171 B1 * 4/2016 Iacono ..... A63B 71/146
2007/0067891 A1 * 3/2007 Schauffele ..... A63B 71/146 2/161.1
2008/0034468 A1 * 2/2008 Kleinert ..... A41D 19/01582 2/159
2008/0109934 A1 * 5/2008 Widdemer ..... A41D 19/01523 2/159
2008/0201822 A1 * 8/2008 Oshima ..... A41D 19/01547 2/161.3
2009/0100573 A1 * 4/2009 Coulter ..... A41D 19/01582 2/161.1
2010/0275342 A1 * 11/2010 Sweeney ..... A41D 19/01505 2/167
2011/0265239 A1 11/2011 Kanemitsu et al.
2017/0086517 A1 * 3/2017 Jones ..... A41D 19/0017

* cited by examiner

BATTING GLOVE

CROSS-REFERENCE TO RELATED APPLICATIONS

This application has no related applications.

STATEMENT REGARDING FEDERALLY SPONSORED RESEARCH OR DEVELOPMENT

The inventions described and claimed in this application were not made under federally sponsored research and development.

BACKGROUND OF THE INVENTION

This invention relates to a professional style batting glove. More specifically, this invention relates to a batting glove with a locking strap to simultaneously secure the glove to the user's wrist and to stretch the palm material of the glove across the user's palm.

The design and construction of professional style batting gloves has become increasing sophisticated as professional and serious amateur athletes expect both comfort and a precision fit in their batting gloves. Batting gloves have evolved as a combination of thin, soft leather panels for its tactile qualities with fabric sections of various elastic properties for improved fit. Such gloves characteristically include an open cuff of stretchable material which is open in either of the regions below the thumb stall, or the back of the glove, or the side of the hand. A locking strap of uniform wide is typically secured to one edge of the open cuff and includes a strip of hook and latch material such as VELCRO. A corresponding strip of hook and latch material is secured to the back of the cuff so that the locking strip can tightly encircle the user's wrist.

Comparatively little attention has been given to the tensioning of the leather palm material of conventional batting gloves except to rely on the elasticity of the material across the back of the glove or at the sides of the palm section in order to stretch material across the user's palm. Such solutions have not proven entirely satisfactory and can still result in bunching or puckering of the palm leather when the user grasps a baseball bat.

Accordingly, the need remains in the design and construction of batting gloves for improvements to tension the leather palmar material across the user's hand when a locking strip is deployed to secure the glove around the user's wrist. A primary goal of this invention is to meet this need and to provide such improvements.

SUMMARY OF THE INVENTION

More specifically, an object of the invention is to provide a professional style batting glove employing the tactile qualities of thin, soft leather for the palmar region and for finger and thumb stalls with strategically located sections of elastic material for improved fit and comfort while providing a locking strap to simultaneously secure the glove around the user's wrist and to tension the palmar material across the user's palm.

Another object of the invention is to provide a batting glove with sections of elastic material across the back of the glove for improved fit and comfort.

Another object of the invention is to provide a batting glove with an access opening including a split cuff and an edge split along the side of the hand so that even a user with large hands can easily insert the hand into the glove.

Another object of the invention is to provide a batting glove of the character described wherein a locking strap of uniform width is secured to one edge of the split cuff of elastic material and includes a strip of hook and latch material such as VELCRO to mate with a corresponding strip of hook and latch material on the cuff to tightly encircle the user's wrist.

Another object of the invention is to provide a batting glove of the character described wherein a non-yielding tensioning swath is attached to the edge of the palmar material and to the locking strap to tension the palmar material when the locking strap is deployed around the user's wrist.

Another object of the invention is to provide a batting glove of the character described including imprinted palm lines on the palmar material to prevent bunching or puckering when the user grasps a baseball bat.

In summary, an object of the invention is to provide a professional style batting glove with a palmar region and finger and thumb stalls of thin and soft tactile leather interconnected with elastic material sections for improved fit and comfort. A split wrist cuff integral with a side split assists in placing the glove on the user's hand. A locking strap of uniform width is attached to the wrist cuff and sections of hook and loop material permit the locking strap to tightly encircle the user's wrist. A triangular patch of non-yielding material is attached to the edge of the palmar region and to the locking strap to tension the palmar region across the user's palm when the locking strap is deployed.

Other and further objects of the invention, together with the features of novelty appurtenant thereto, will appear in the course of the detailed description of the drawings.

BRIEF DESCRIPTION OF THE DRAWINGS

In the following description of the drawings, in which like reference numerals are employed to indicate like parts in the various views.

DETAILED DESCRIPTION OF THE DRAWINGS

Figure 1:
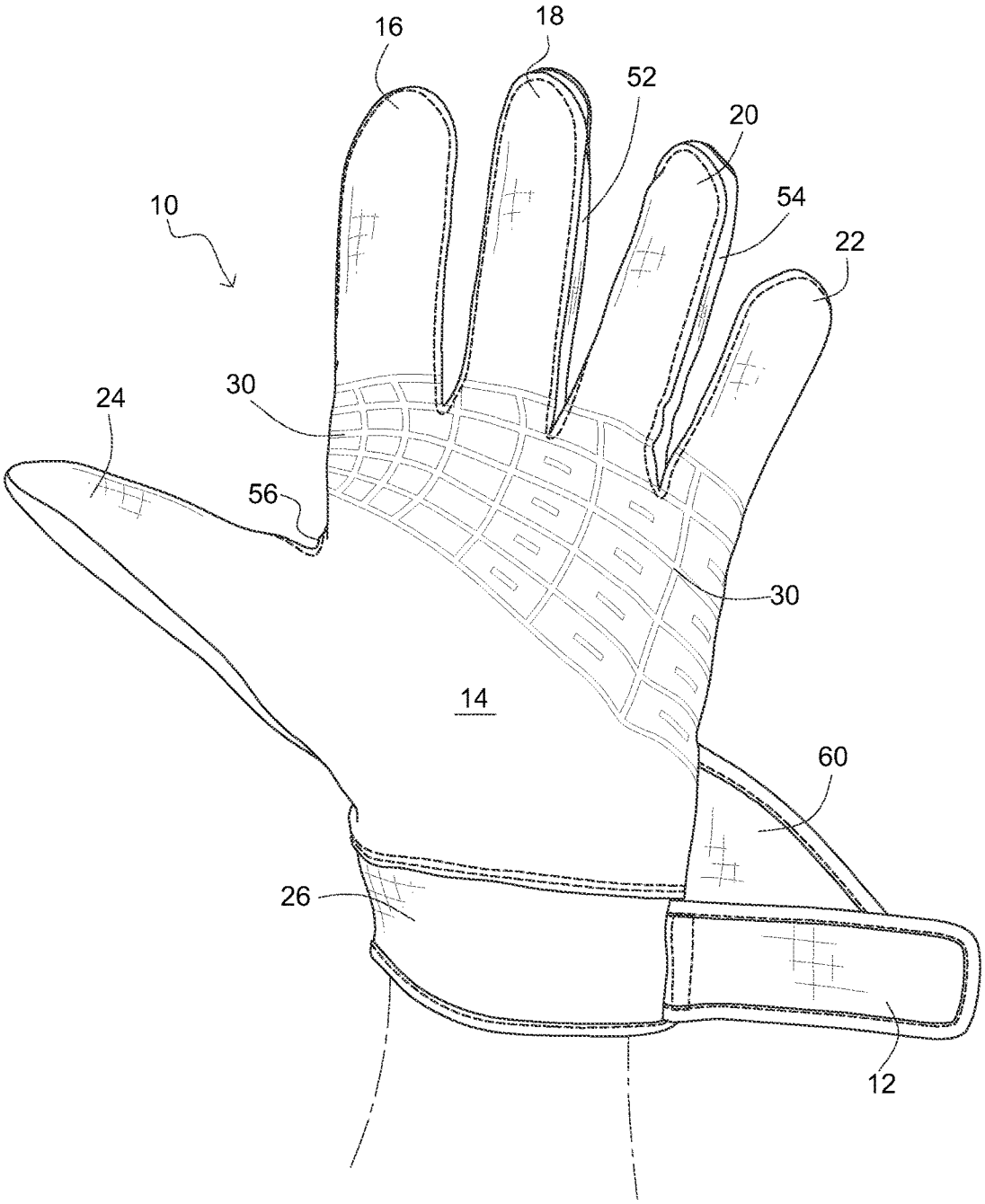
FIG. 1 is a front elevational view of a batting glove constructed in accordance with one embodiment of the invention and showing the locking strap in an open position.
Figure 2:
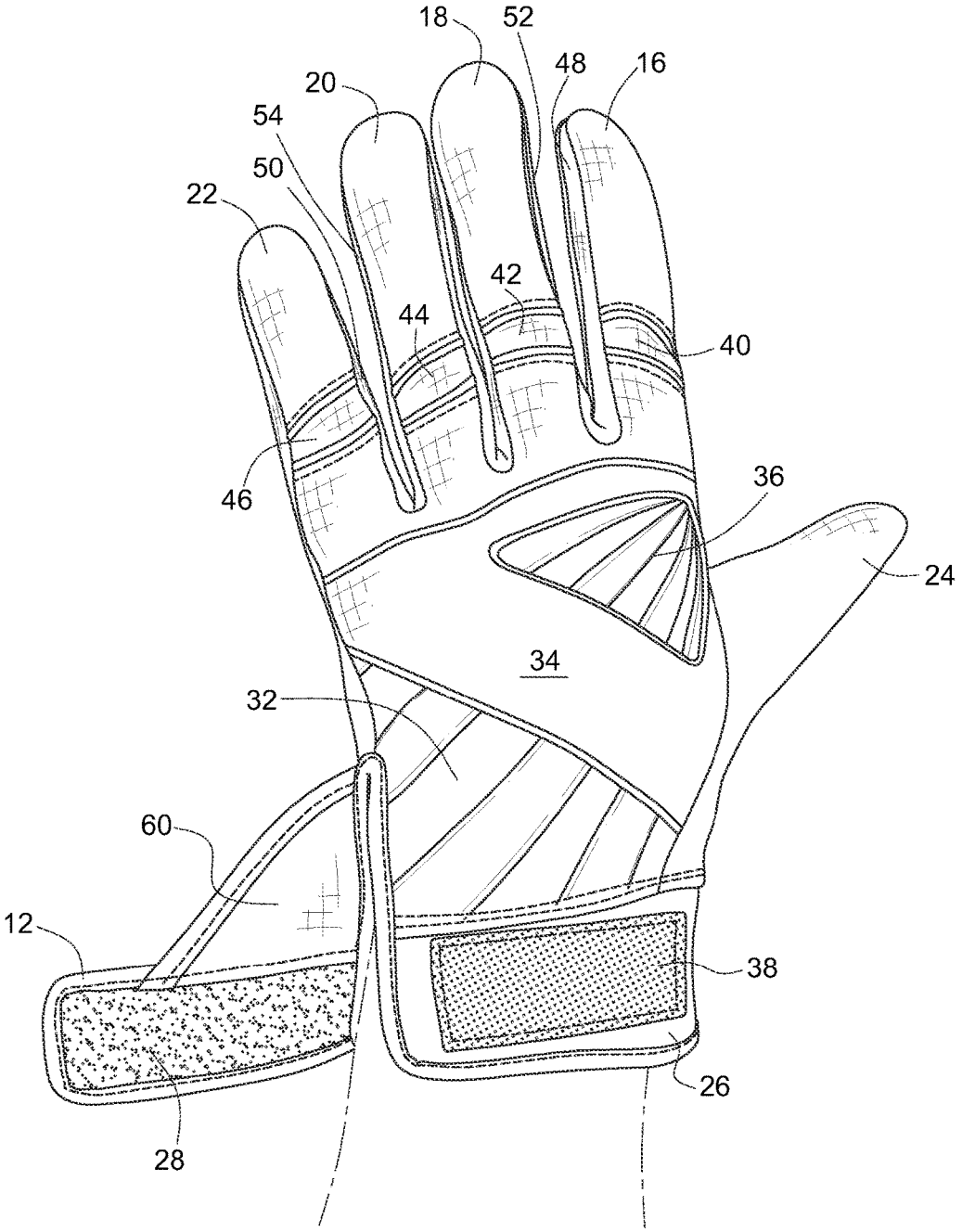
FIG. 2 is a rear elevational view of the batting glove showing the locking strap in an open position.
Figure 3:
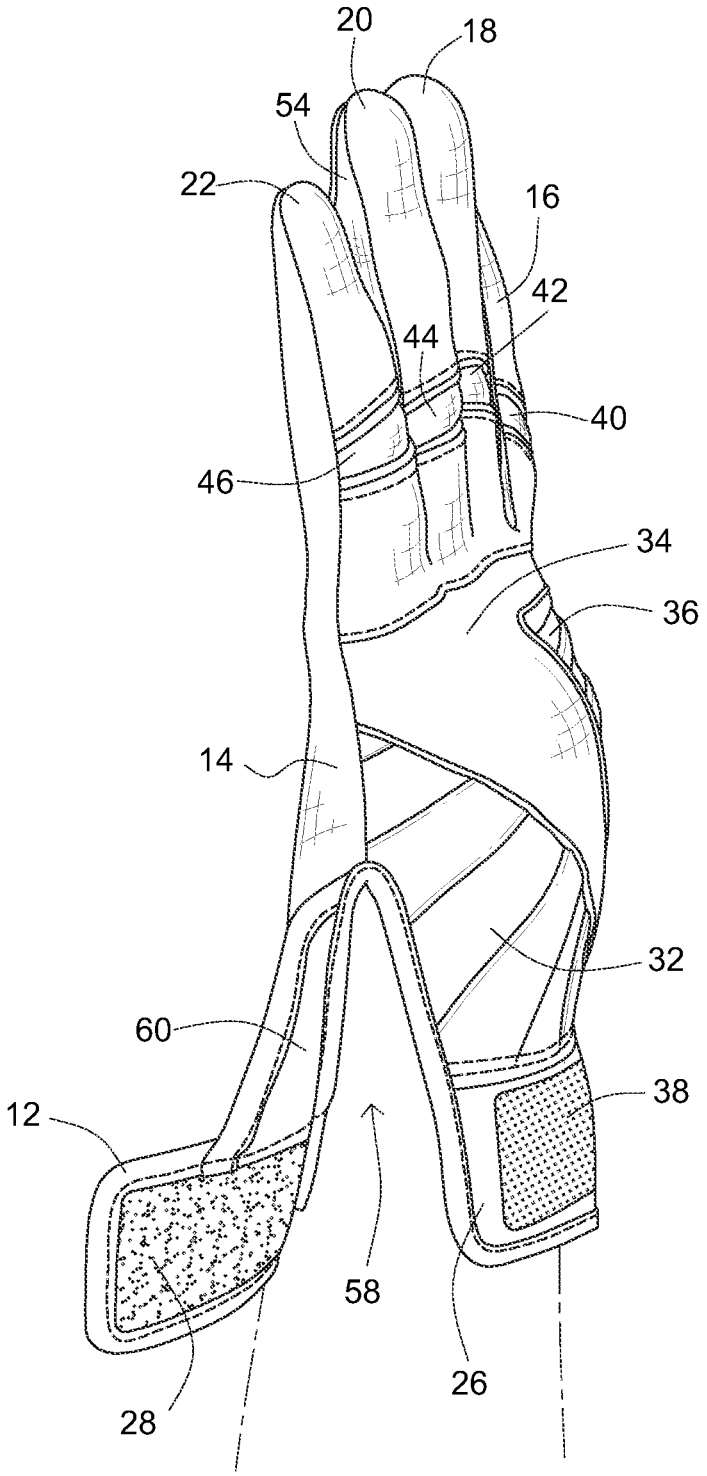
FIG. 3 is a side elevational view of the batting glove showing the locking strap in an open position.

Referring to the invention in greater detail, attention is first directed to FIGS. 1-3 showing a batting glove, generally designated by the numeral 10, with its associated locking strap 12 in an open or unlatched position.

The batting glove 10 has a proximal or palmar side as illustrated in FIG. 1 comprising a palm material section 14, proximal sides of finger stalls 16, 18, 20 & 22, proximal side of thumb stall 24, and a wrist cuff 26. The palm material section 14, proximal sides of finger stalls 16, 18, 20 & 22, and proximal side of thumb stall 24 are preferably integrally formed from a uniform sheet material. Such material is ideally thin, soft, and pliable leather with good tactile qualities for gripping and limited stretchiness for retaining its shape. Attached along the bottom edge of the palm section 14 is wrist cuff 26. Cuff 26 is formed of material being elastic in two dimensions, such as the material known as SPANDEX or an equivalent material, in order to best conform to the user's wrist area.

The cuff 26 is not a continuous band of material. Rather, it is split in the region near the side of the user's hand which corresponds roughly to the lowermost, side edge of the palm section 14. The locking strap 12 is attached to the edge of the cuff 26 just below the lowermost, side edge of the palm section 14. The locking strap 12 is of uniform width and formed from unyielding, non-elastic material to limit stretch thereof. Secured to the backside of the locking strap 12 (see FIGS. 2 & 3) is a strip 28 of hook and loop material, such as the material known as VELCRO or an equivalent material, with the loop material being illustrated in the drawings.

Diagonally across the upper region of the palm section 14 and the lower regions of the finger stalls 16-22 are imprinted on or impressed pattern lines 30 into the leather material. The pattern lines 30 assist in preventing puckering or bunching of the palm section 14 when the user grips a baseball bat.

The distal or backside of the batting glove 10 is illustrated in FIG. 2. Between the edge of the palm section 14 and the thumb stall 24 are one or more sections (3 sections 32, 34 & 36 being illustrated) of elastic material having various degrees of stretchiness in two dimensions, such as the material known as SPANDEX or an equivalent material. The upper regions of the elastic sections 32-36 preferably overlie the metacarpophalangeal joints of the fingers when the glove 10 is worn by a user. The lower edge of the elastic section 32 is attached to the wrist cuff 26.

Secured to the backside of the wrist cuff 26 (see FIGS. 2 & 3) is a strip 38 of hook and loop material, such as the material known as VELCRO or an equivalent material, with the hook material being illustrated in the drawings.

The backsides of the finger stalls 16-22 are preferably formed of the same leather material as used on the palmar side of the glove 10. Intermediate the lengths of the finger stalls 16-22 may be secured elastic sections 40, 42, 44 & 46, respectively, to correspond substantially to the proximal interphalangeal joints of the user's hand in order to facilitate bending of the fingers and gripping of a baseball bat.

On the inside lengths of finger stalls 16 & 22 (i.e., index and little fingers) are sections 48 & 50, respectively, of elastic materials. Also on both sides of finger stalls 18 & 20 (i.e., middle and ring fingers) are sections 52 & 54, respectively, of elastic materials. These sections 48-54 of elastic material provide improved fit and comfort in the finger stalls 16-22.

Likewise, along the length of the thumb stall 24 may be included a narrow section 56 of elastic material, only a portion of which is seen in the drawing views, to improve the fit and comfort of the thumb stall 24.

The side of the batting glove 10 is illustrated in FIG. 3. Corresponding to and integrally contiguous with the split in the wrist cuff 26 is a split or opening 58 between the palm section 14 and the elastic section 32 on the back of the glove. The opening 58 extends from the wrist cuff 26 to a point approximately half way between the wrist cuff 26 and the lower end of the finger stall 22. Such point corresponds about midway on the metacarpal bone associated with the user's little finger. The split in the wrist cuff 26 and the opening 58 between the palmar and backside of the glove 10 permits ease of access for inserting the user's hand, even for a larger or beefy hand as may be the case for professional and serious amateur baseball athletes.

As best illustrated in FIGS. 2 & 3 of the drawings, a triangular material patch 60 is securely attached along at least a substantial portion of the length of the locking strap 12 and also along the palm section 14 from the wrist cuff 26 to the uppermost point of the opening 58. It is important that patch 60 be formed from unyielding, non-elastic material to limit stretch thereof. This provides means for tensioning the palm section 14 when the locking strap 12 is deployed around the user's wrist.

Figure 4:
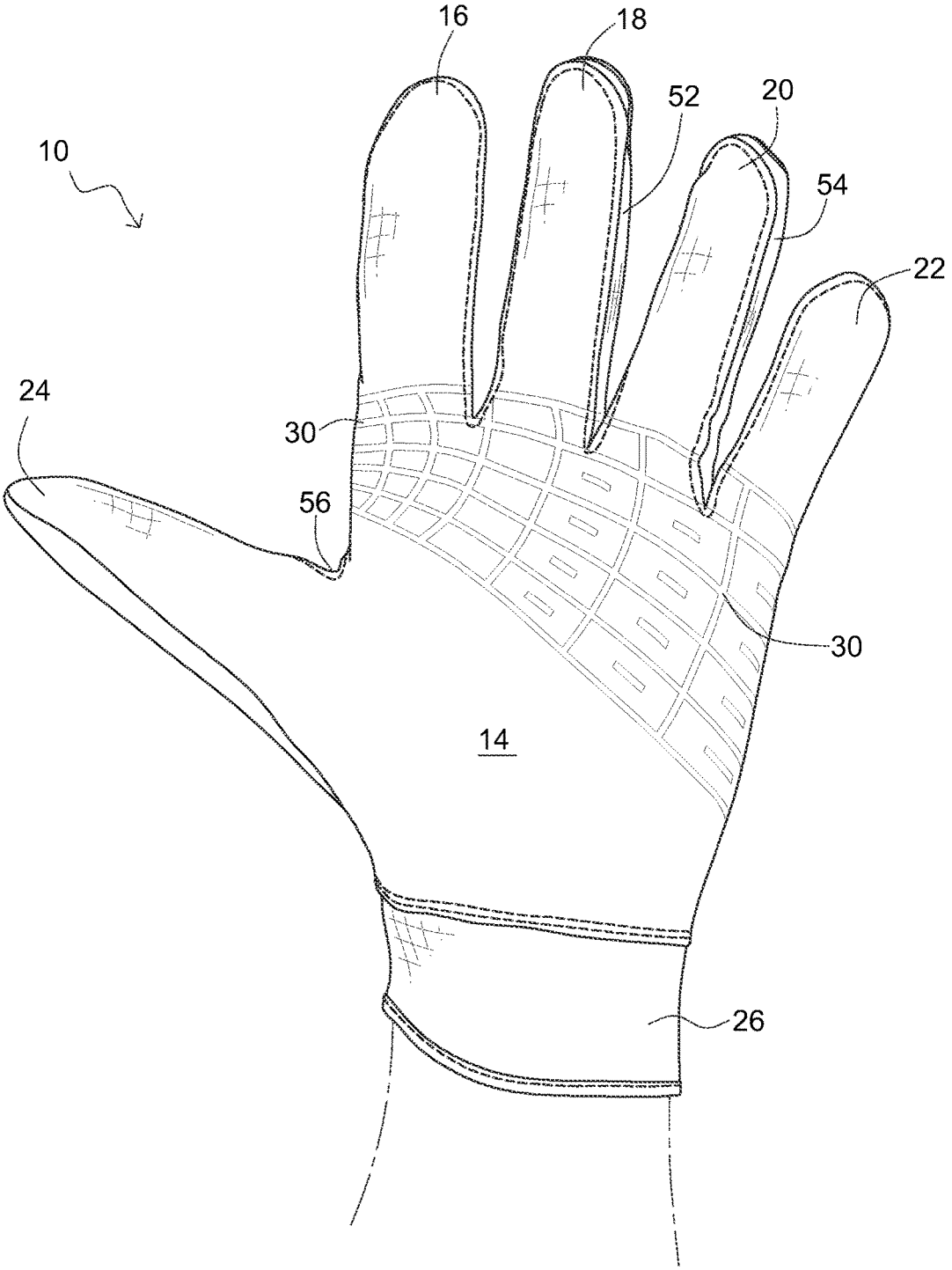
FIG. 4 is a front elevational view of the batting glove as in FIG. 1 but showing the locking strap in a closed position.
Figure 5:
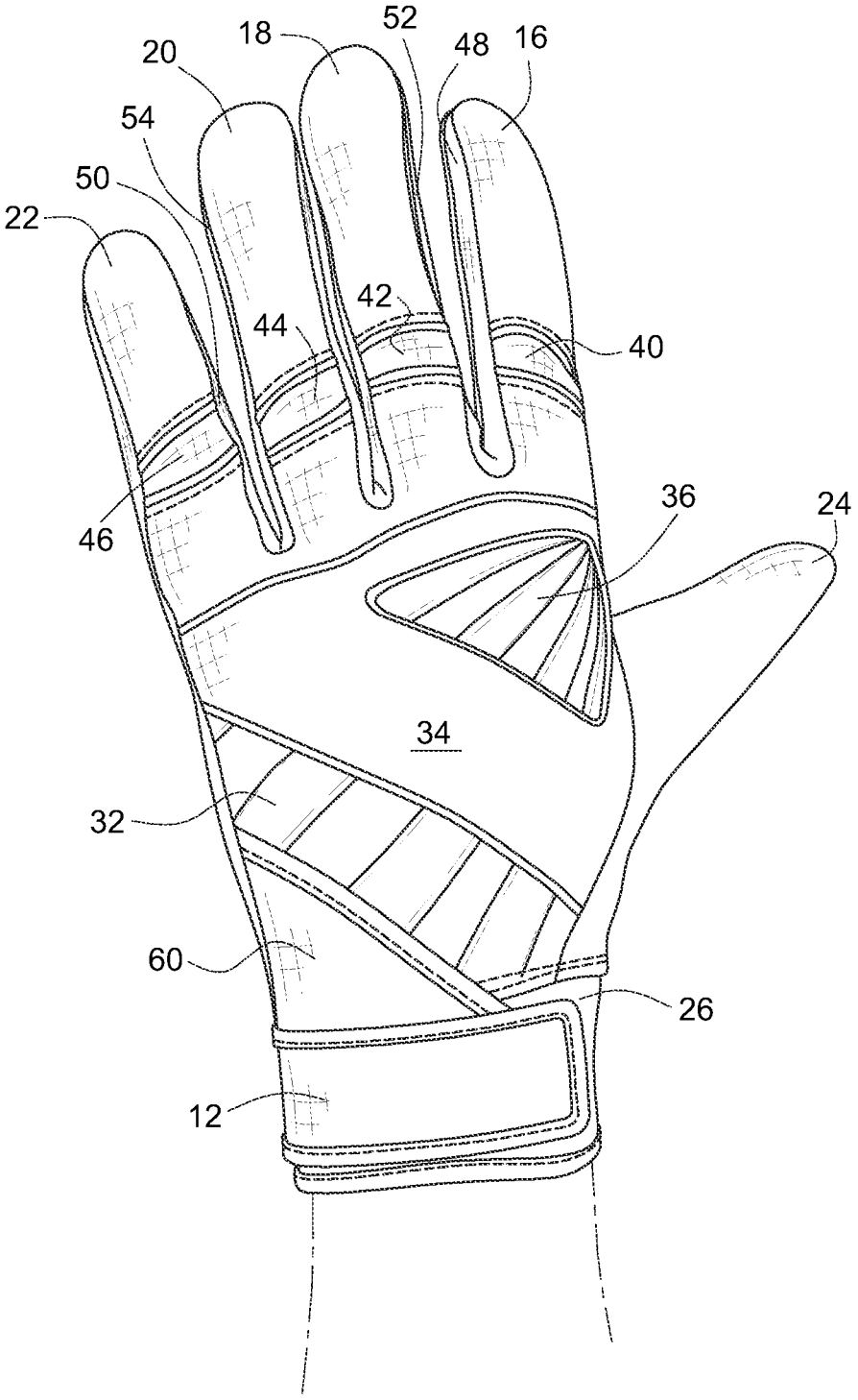
FIG. 5 is a rear elevational view of the batting glove as in FIG. 2 but showing the locking strap in a closed position.
Figure 6:
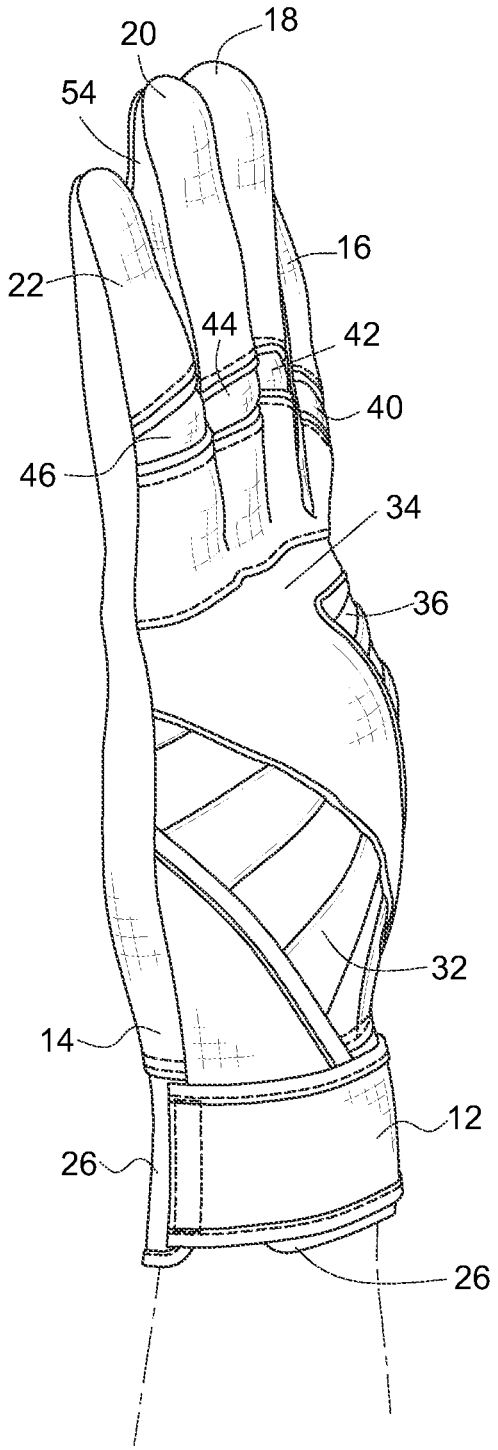
FIG. 6 is a side sectional view of the batting glove as in FIG. 3 but showing the locking strap in a closed position.

FIGS. 4-6 illustrate the batting glove 10 positioned on and secured by locking strap 12 to a user's hand. Before deploying the locking strap 12, the user may easily insert the hand into the glove 10 due to the split in the wrist cuff 26 and opening 58 between the palm and backside of the glove. Once the hand is inserted, then locking strap 12 may be pulled to the backside of the glove 10 so that strip 28 of the hook and loop material on the locking strap 12 latches with strip 38 of the hook and loop material on the wrist cuff 26. This action also causes the patch 60 to pull the palm material section 14 across the user's palm to properly tension the palm section 14 and remove any material wrinkles that might otherwise be present.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

Numerals batting glove 10
locking strap 10
palm material section 14
finger stalls 16, 18, 20 & 22
thumb stall 24
wrist cuff 26
strip 28 of hook and loop material
pattern lines 30
elastic sections 32, 34 & 36
strip 38 of hook and loop material
elastic sections 40, 42, 44 & 46
finger stalls 16 & 22-elastic sections 48 & 50
finger stalls 18 & 20-elastic sections 52 & 54
thumb stall 24-narrow section 56
opening 58
triangular material patch 60

Having thus described my invention, I claim:

1. A batting glove having a palmar side and a backside surface, said glove comprising:

four finger stalls;

a thumb stall;

a palm panel on the palmar side of said glove formed of material having tactile and gripping qualities with limited stretchability and being attached to said finger stalls and said thumb stall;

an elastic panel on the backside of said glove and being attached to said finger stalls, said thumb stall, and said palm panel;

a discontinuous wrist band of substantially uniform width attached to said palm panel and to said elastic panel with an opening therein to provide a palmar side edge and a backside edge;

a hand access opening between said palm panel and said elastic panel at one side of said glove opposite said thumb stall and corresponding to said opening in said wrist band, said access opening extending from said wrist band approximately half way between said wrist band and the last of said finger stalls opposite said thumb stall along the edge of said palm panel; and a wrist latch having one edge thereof attached to said wrist band at said palmar ide edge and attached to the edge of said palm panel along said hand access opening, said wrist latch tapering from the upper end of said hand access opening to a terminal edge substantially matching the width of said wrist band;

whereby said wrist latch may be releaseably connected to the backside of said wrist band to securely encircle the user's wrist and to simultaneously tension said palm panel across the user's palm.

2. The batting glove as in claim 1, said palm panel formed of thin, soft, pliable leather with tactile qualities for gripping a baseball bat.

3. The batting glove as in claim 1, said finger stalls and said thumb stall being formed substantially of thin, soft, pliable leather with tactile qualities for gripping a baseball bat.

4. The batting glove as in claim 3, said finger stalls including a thin longitudinal strip of elastic material attached to said leather material to provide improved fit of the finger stalls to the user's fingers.

5. The batting glove as in claim 3, said thumb stall including a thin longitudinal strip of elastic material attached to said leather material to provide improved fit of the thumb stall to the user's thumb.

6. The batting glove as in claim 3 including on the backside of said glove a lateral strip of elastic material attached to said leather material in the region of said finger stalls to overlie the proximal interphalangeal joints of the user's hand in order to facilitate bending of the fingers and gripping of a baseball bat.

7. The batting glove as in claim 1 further including strips of hook and loop material secured to the backside of said wrist band and to said wrist latch to adjustably and releaseably connect said wrist latch to the backside of said wrist band to securely encircle the user's wrist and to simultaneously tension said palm panel across the users palm.

8. The batting glove as in claim 7 including diagonal pattern lines impressed into the leather material in the upper region of said palm panel to assist in preventing puckering and bunching of the leather material when the user grips a baseball bat.

9. The batting glove as in claim 1, said wrist latch comprising a locking strap of uniform width attached to said wrist band at said palmar side edge and adapted to be releaseably connected to the backside of said wrist band to securely encircle the user's wrist.

10. The batting glove as in claim 9, said wrist latch further comprising a triangular patch attached along at least a substantial portion of the length of the locking strap and also attached to said palm panel along said hand access opening to tension said palm panel across the user's palm when said locking strap is releaseably connected to the backside of said wrist band to securely encircle the users wrist.

11. The batting glove as in claim 10, said locking strap and said triangular patch both being formed of unyielding, non-elastic material to limit stretchability thereof.

12. The batting glove as in claim 1 including diagonal pattern lines impressed into the leather material in the upper region of said palm panel and the lower regions of said finger stalls to assist in preventing puckering and bunching of the leather material when the user grips a baseball bat.

* * * * *